US005370246A

United States Patent [19]

Traynor

[11] Patent Number: 5,370,246

[45] Date of Patent: Dec. 6, 1994

[54] ARTICLE STORAGE CADDY

[76] Inventor: Joan G. Traynor, 4517 Aubrey Ave., Philadelphia, Pa. 19114

[21] Appl. No.: 926,499

[22] Filed: Aug. 5, 1992

[51] Int. Cl.[5] ..... A47F 5/08

[52] U.S. Cl. ..... 211/86; 211/113; 206/225; 224/270; 132/312; 383/11; 383/39

[58] Field of Search ..... 211/34, 86, 113, 118; 132/312; 206/581, 225, 233; 224/270, 30 A, 223, 227, 249, 904; 383/16, 24, 11, 38, 39

[56] References Cited

U.S. PATENT DOCUMENTS

| | | | |
|---|---|---|---|
| 1,214,282 | 1/1917 | Day | 224/249 X |
| 1,261,733 | 4/1918 | Gerlach | 383/39 |
| 1,685,277 | 9/1928 | Dryden . | |
| 1,686,002 | 10/1928 | Herzon . | |
| 1,874,945 | 8/1932 | Ferguson | 383/39 |
| 2,557,674 | 6/1951 | McRae . | |
| 2,650,784 | 9/1953 | Thayer et al. . | |
| 2,861,735 | 11/1958 | Faltin | 383/11 |
| 3,967,666 | 7/1976 | Farrar | 383/39 |
| 4,240,480 | 12/1980 | Strobel | 383/22 X |
| 4,431,154 | 2/1984 | Hamm | 248/215 |
| 4,484,367 | 11/1984 | Jenkins | 5/425 |
| 4,585,127 | 4/1986 | Benedict | 211/34 |
| 4,796,790 | 1/1989 | Hamilton | 224/227 X |
| 4,831,673 | 5/1989 | Winckler | 248/214 |
| 4,901,899 | 2/1990 | Barrett | 224/223 |
| 4,953,765 | 9/1990 | Little et al. | 224/901 |
| 4,967,913 | 11/1990 | Bayer | 211/118 X |
| 5,024,361 | 6/1991 | Flowers | 383/39 X |
| 5,125,519 | 6/1992 | Cambria | 211/118 |
| 5,209,344 | 5/1993 | Smith | 383/39 X |

*Primary Examiner*—P. Austin Bradley
*Assistant Examiner*—Jeanne M. Elpel
*Attorney, Agent, or Firm*—Volpe and Koenig

[57] ABSTRACT

A patient caddy of the type which is suspended from a patient support apparatus to provide convenient storage for miscellaneous items. The caddy is comprised of a fabric panel having a multipocketed face portion and a folded portion. A textile fastening strip releasably secures the face portion to the folded portion and establishes a tubular void therebetween.

4 Claims, 7 Drawing Sheets

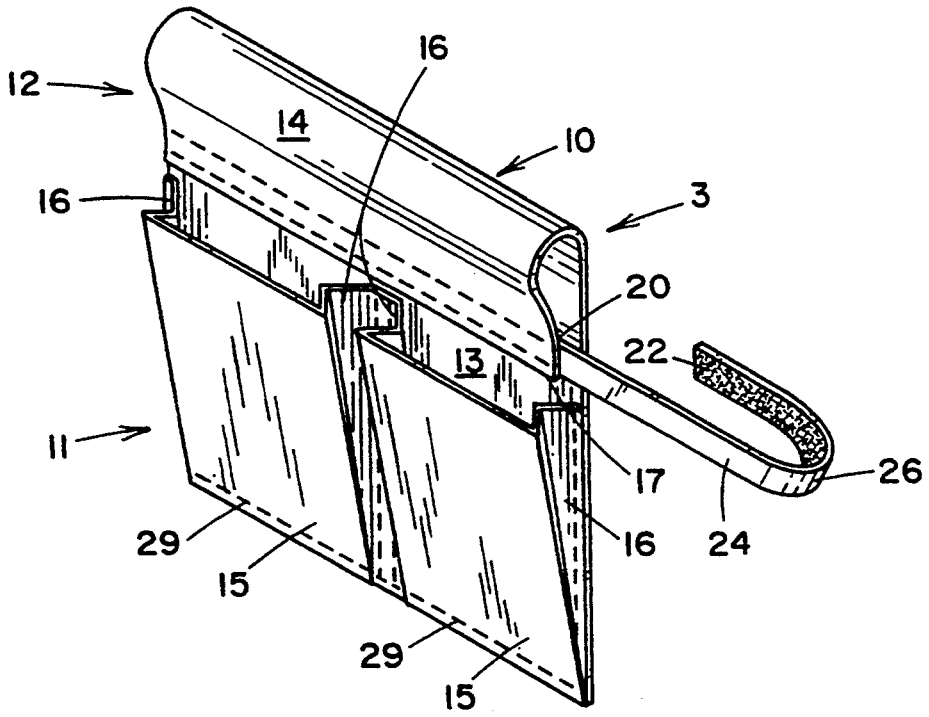
FIG. 9
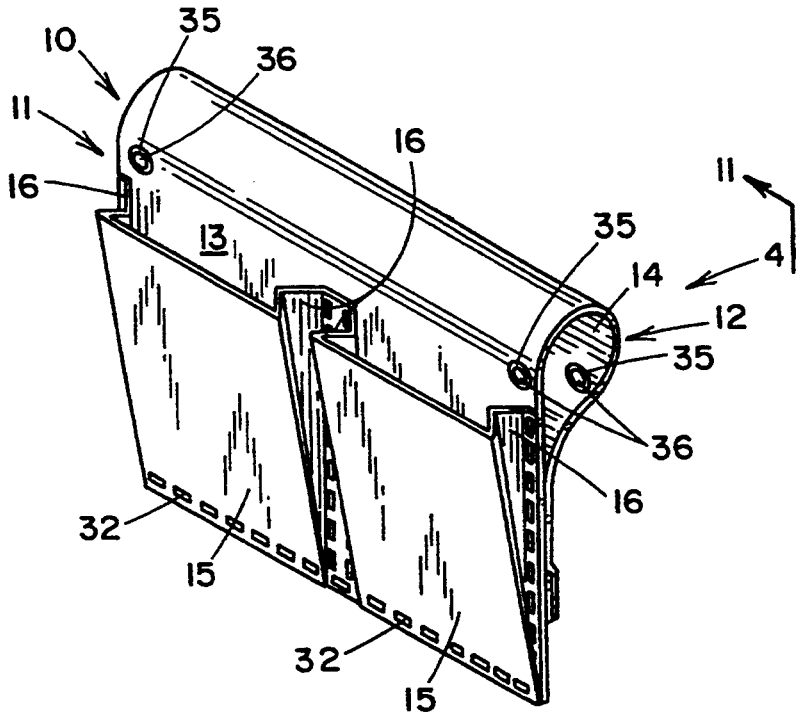
FIG. 10
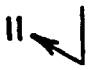

ARTICLE STORAGE CADDY

BACKGROUND OF THE INVENTION

1. Field of the Invention

The present invention relates to a small article storage caddy. More particularly it relates to a storage caddy which can be quickly and easily installed or removed from a patient support apparatus, such as a hospital bed or wheelchair, to allow convenient placement of small articles or necessities within the patient's reach.

2. Description of the Prior Art

There has been a recognized need to provide convenient bedside storage of small patient necessities and amenities while they are in confinement. Various holders with clips or clamps designed to engage bed railings, as disclosed in U.S. Pat. Nos. 2,650,784, 4,431,154 and 4,831,673, have been designed in response to this need.

However, the prior holders have certain drawbacks. Because their attachment means are adapted for use with certain types of bed railings, no single holder can be universally used with the various types of patient support apparatuses. These prior holders also lacked the ability to be easily removed and reinstalled to allow for transfer with the patient, or to allow custom placement to suit each individual patient's needs. Additionally, the cost of these holders is generally prohibitive to disposable usage.

The bedside article bag disclosed in U.S. Pat. No. 3,967,666 recognized and addressed some of the concerns with the previously discussed holders. This patent discloses an article bag comprised of two cloth flaps, each having a plurality of pockets, adapted for support in saddle bag fashion over a bedrail. A series of snap fasteners secure it to the bedrail. This bag still has serious limitations. It can only be placed at the limited locations along a bed rail where there are no intervening supports. In uses where the rail is not horizontally disposed, the bag can slide down the rail and out of reach. Additionally, the snap fastening means are inconvenient for removal and reinstallation. This makes the bag unsuitable for transfer along with the patient.

A nurse call device holder made of a flexible sheet is disclosed in U.S. Pat. No. 4,484,367. The flexible sheet is wrapped around two parallel rails of a hospital bed railing and attached to itself with self-adhering textile strips such as Velcro ® fasteners. A pocket attached to the front face of the flexible sheet holds the nurse call device. The disclosed holder is not adapted for universal use. Parallel bed rails set at a given spacing are required for its attachment. Additionally, it can only be installed at positions along the parallel bed rails which do not have interfering supports.

SUMMARY OF THE INVENTION

The present invention discloses an improved patient caddy of the type which is suspended from a patient support apparatus to provide convenient storage for miscellaneous items. The caddy is preferably comprised of a continuous fabric panel consisting of a face portion and a folded portion. A plurality of pockets are provided on the face portion. Attached to the folded portion is a textile fastening strip which releasably engages the face portion and establishes a tubular void therebetween.

It is an object of this invention to provide a patient caddy which can be installed in a variety of locations to suit a patient's needs.

It is an object of this invention to provide a patient caddy which can be installed at any position along a rail of a patient support apparatus.

It is an object of the invention to provide a patient caddy which can be easily removed from one patient support apparatus and reinstalled on another support apparatus for transfer along with the patient.

It is an object of this invention to provide a low cost, disposable patient support caddy.

It is an object of this invention to provide a patient caddy which will not slide out of position.

BRIEF DESCRIPTION OF THE DRAWINGS

FIG. 8(*b*) is a perspective view of the folded side of the second embodiment installed between support locations.

FIG. 9 is a perspective view of a third embodiment of the patient caddy.

FIG. 10 is a perspective view of a fourth embodiment of the patient caddy.

DESCRIPTION OF THE PREFERRED EMBODIMENTS

Figure 1:
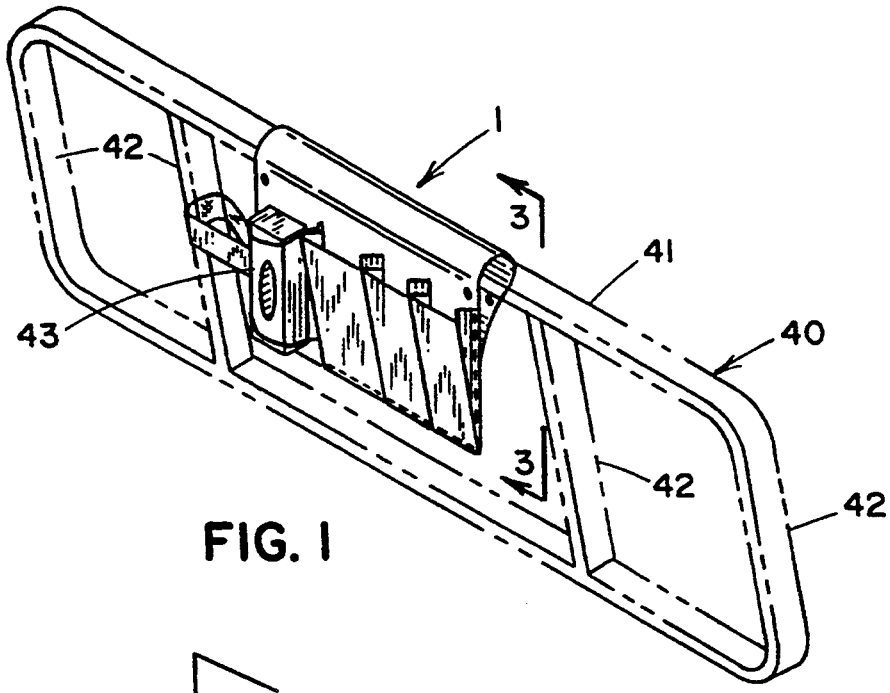
FIG. 1 is a perspective view of a first embodiment of a patient caddy installed on a patient support apparatus.

The preferred embodiments will be described with reference to the drawing figures wherein the same numeral indicates a like element throughout.

Referring to FIG. 1, there is shown a first embodiment 1 of the patient caddy according to the present invention. The caddy 1 is shown as installed on a portion of a patient support apparatus 40. This could be the arm of a wheelchair or the railing along the side of a hospital bed; however, the form of the patient support apparatus is of no significance to the present invention so long as there is a rail 41.

Figure 2:
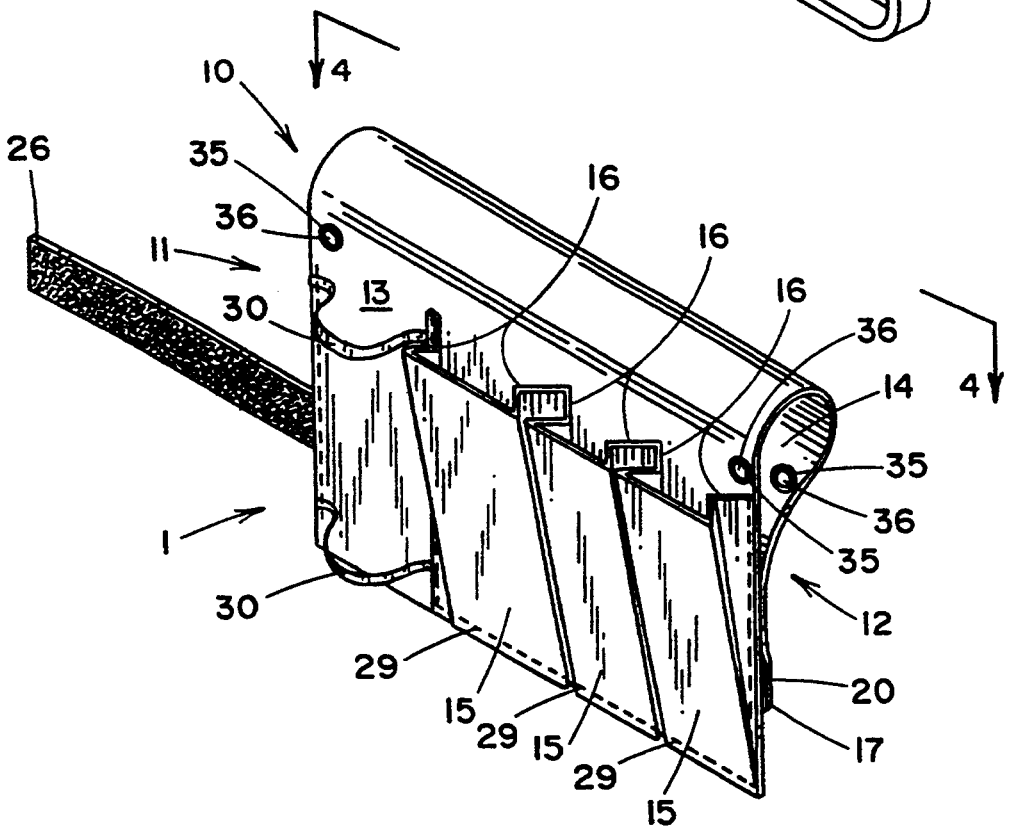
FIG. 2 is a perspective view of the first embodiment of the patient caddy.
Figure 3:
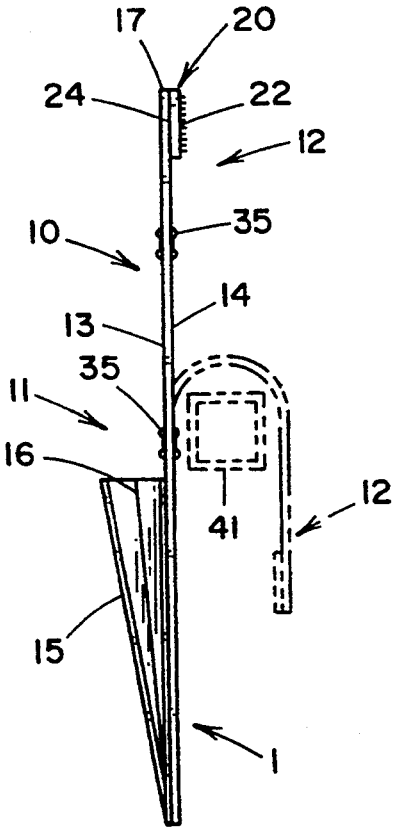
FIG. 3 is a view along line 3—3 in FIG. 1.
Figure 4:
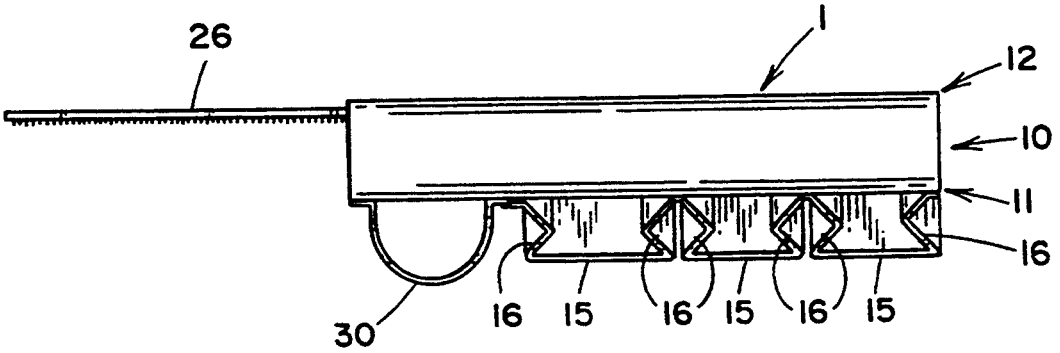
FIG. 4 is a top plane view along line 4—4 in FIG. 2

Referring to FIGS. 2, 3 and 4, the first embodiment 1 is shown in more detail. The patient caddy 1 is comprised of a continuous fabric panel 10 having a front 13 and a back 14. The fabric panel 10 also has a face portion 11 and a folded portion 12. The face portion 11 has pockets 15 attached to its front 13 and as illustrated in FIG. 3, the folded portion 12 is the portion of the fabric panel 10 which is to be folded over a rail at installation. The pockets 15 have pleated sides 16 which allow the caddy to remain compact for storage, and can be easily expanded during use to accommodate larger objects. A pair of elastic loops 30, which are spaced apart and in alignment with each other, are attached to the face portion 11 adjacent to the pockets 15. A tissue box 43 can be secured to the caddy 1 by the elastic loops 30, as illustrated in FIG. 1.

The pockets 15 and elastic loops 30 are attached to the fabric panel 10 at seam locations 29. The seams are made by conventional stitching using, preferably, a synthetic monofilament thread.

Attached along the upper edge 17 on the back 14 of the folded portion 12 is a hook type textile fastening strip 20. The fastening strip 20 has a hooked side 22 which is exposed, and a plain side 24 which is attached to the fabric panel 10. The textile fastening strip 20 extends beyond the side of the folded portion 12 to form a strap 26. Suitable hook type fasteners are available under the Velcro ® trade name.

Having described the structure of the patient caddy 1, its installation will be explained with reference to FIGS. 1 and 3. The folded portion 12 of the fabric panel 10 is placed over the rail 41. The hook type textile fastening strip 20 attached along the upper edge 17 of the folded portion 12 of the fabric panel 10 is then secured to the back 14 of face portion 11. Strap 26 is wrapped around the support 42 to prevent the caddy 1 from sliding along the rail 41. The strap 26 is secured to the front 13 of the face portion 11.

Figure 5:
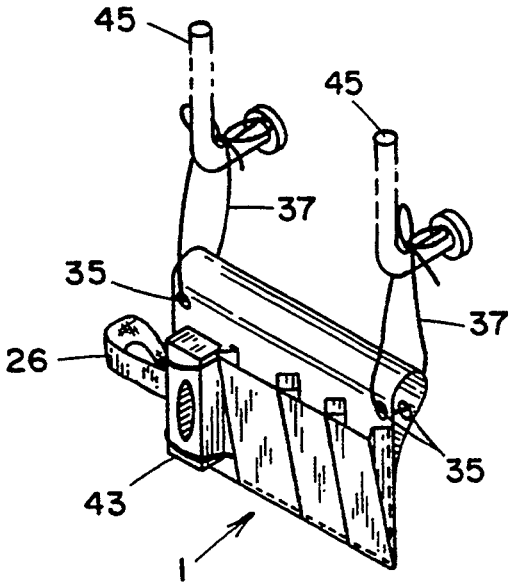
FIG. 5 is a perspective view of an alternate installation of the first embodiment.

Referring to FIG. 5, an alternate installation of the patient caddy 1 is illustrated. For added versatility, complementary pairs of apertures 36 are located in the face and folded portions 11 and 12 on each side of the patient caddy 1. Eyelets 35 are secured around the periphery of the apertures 36. Strings or ribbons 37 are inserted through the complementary pairs of eyelets 35 in the face and folded portion 11 and 12 on both sides of the caddy 1. The strings are tied to vertically disposed support rails 45 to support the caddy. Strap 26 is folded back and stowed between the face and folded portions 11 and 12.

Figure 6:
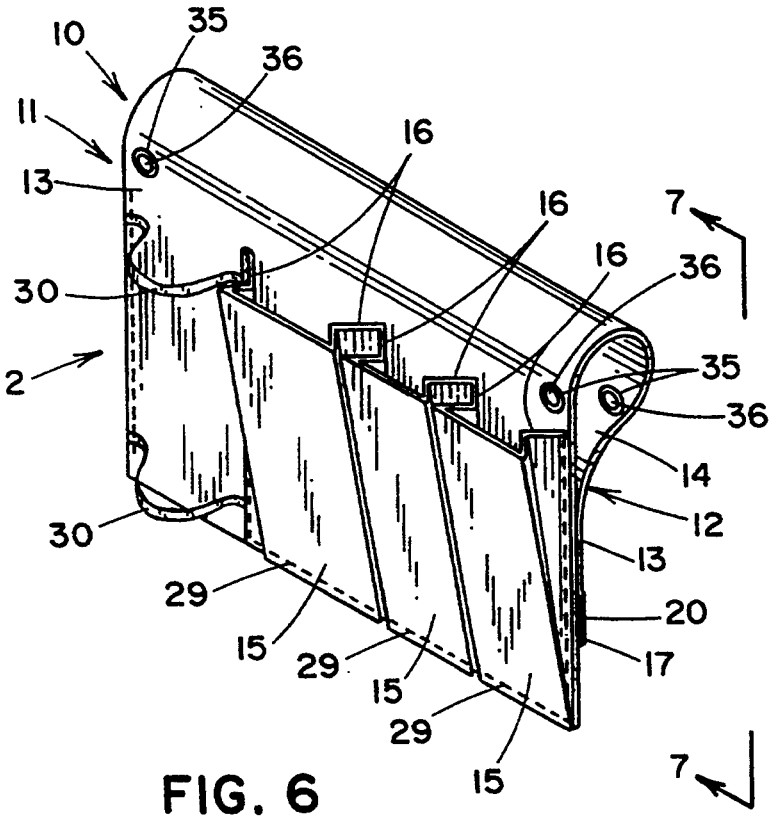
FIG. 6 is a perspective view of a second embodiment of the patient caddy.
Figure 7:
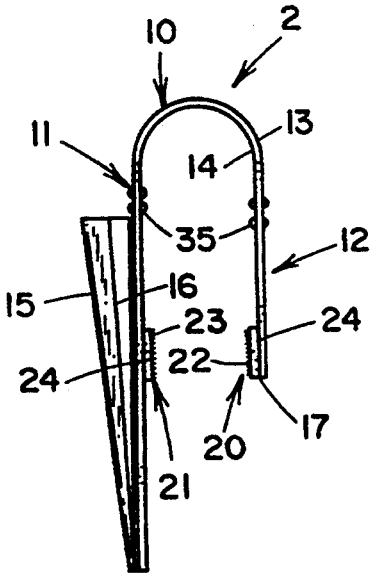
FIG. 7 is a view along line 7—7 in FIG. 6.
Figure 8A:
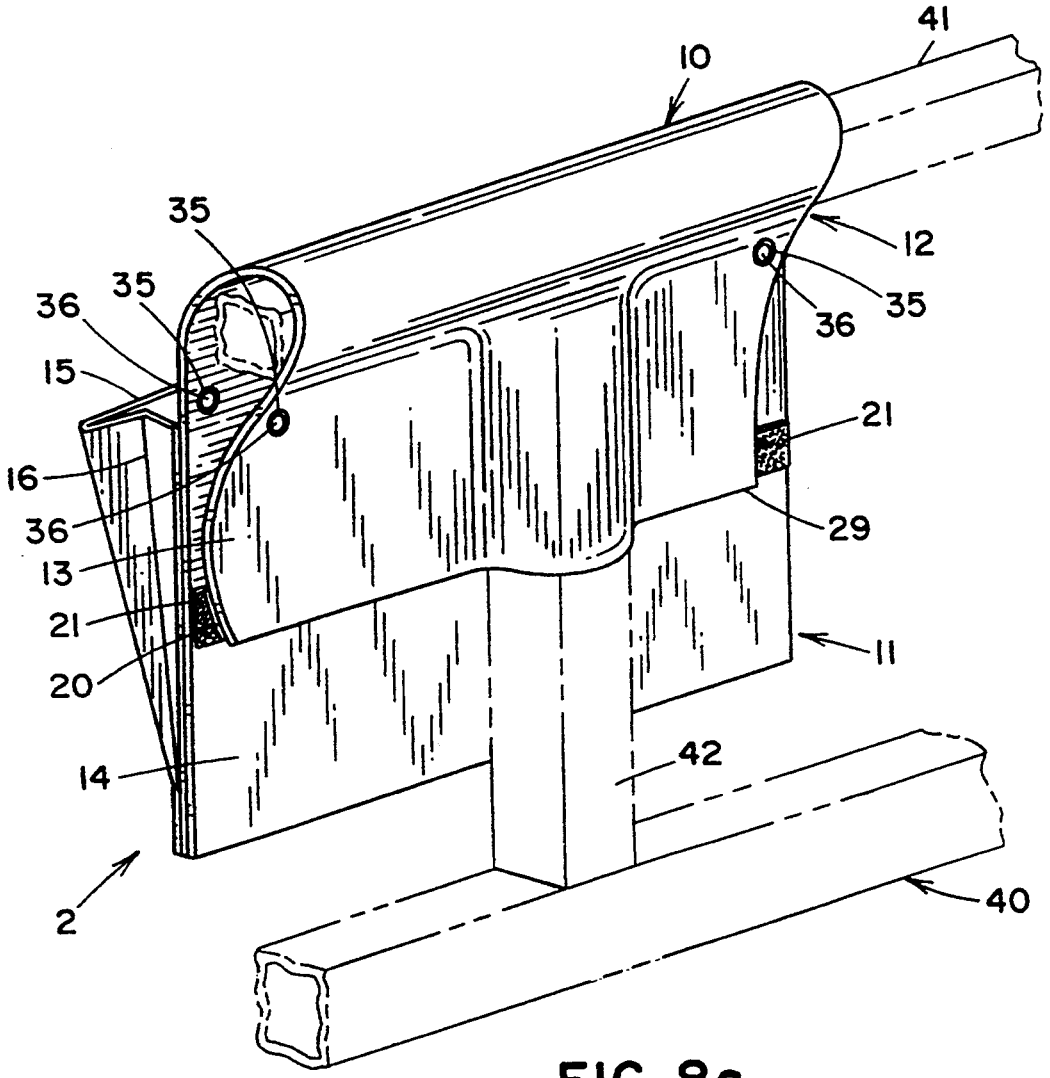
FIG. 8(*a*) is a perspective view of the folded side of the second embodiment installed at a support location along a rail of a patient support apparatus.
Figure 8B:
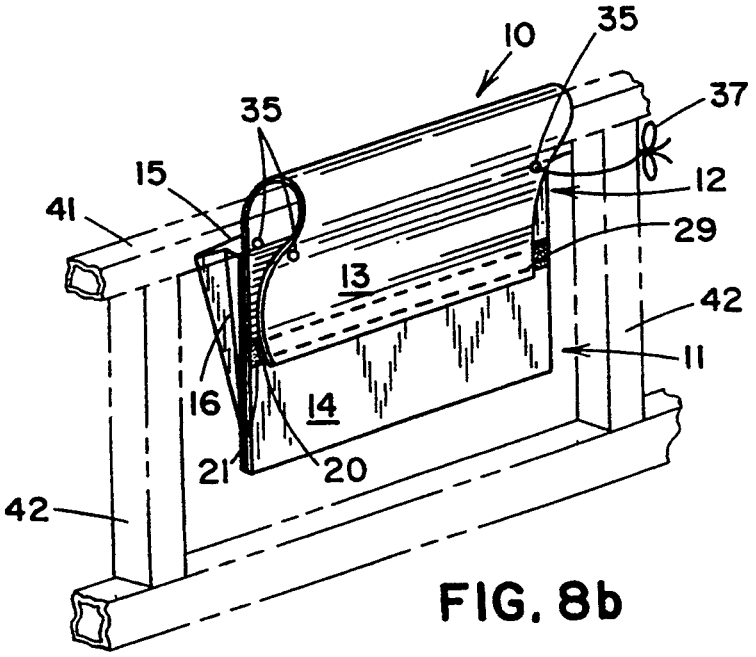

A second embodiment 2 of the patient caddy is shown in FIGS. 6, 7, 8(*a*) and 8(*b*). This second embodiment is similar to the first embodiment except that strap 26 has been omitted. A pile type textile fastening strip 21 has also been attached to the back 14 of the face portion 11 in a complementary position to the hook type fastening strip 20 on the folded portion 12. The pile fastening strip 21 has a pile side 23 which is exposed, and a plain side 24 which is attached to the fabric panel 10. The pile side 23 is releasably engaged by the hook side 22 of the hook fastening strip 20 upon installation of the caddy 2. Suitable pile type fasteners are also available under the Velcro ® trade name.

Referring to FIGS. 8(*a*) and 8(*b*), the folded portion 12 of the patient caddy 2 is shown more in more detail. As illustrated in FIG. 8(*a*), the folded portion 12 of the fabric panel 10 can be deformed to accommodate installation over an intervening post 42 supporting rail 41. This allows the caddy 2 to be installed at any position along the rail 41 to accommodate a given patients needs. Installation in this manner also obviates the need for the strap 26.

In FIG. 8(*b*), the patient caddy 2 is shown installed on rail 41 between supports 42. The string 37 is inserted through the pair of eyelets 35 in the face and folded portions 11 and 12 on one side of the patient caddy 2, and is tied to the support 42 to prevent the caddy 2 from sliding.

Referring to FIG. 9, a third embodiment of the patient caddy is shown. The third embodiment 3, is comprised of a continuous fabric panel 10 having two pleated pockets 15 attached to the front 13 of the face portion 11. A hook type textile fastening strip 20 including a strap portion 26 is fastened to the front 13 along the top edge 17 of folded portion 12.

In use, the folded portion 12 is placed over a rail (not shown) and the hook type textile fastening strip 20 releasably engages front side 13 of the face portion 11 above the pockets 15. Strap 26 as previously described is secured around a support post (not shown) to prevent the caddy from sliding. This third embodiment is particularly adapted for use in areas where there is limited access to the back side of a rail.

Figure 11:
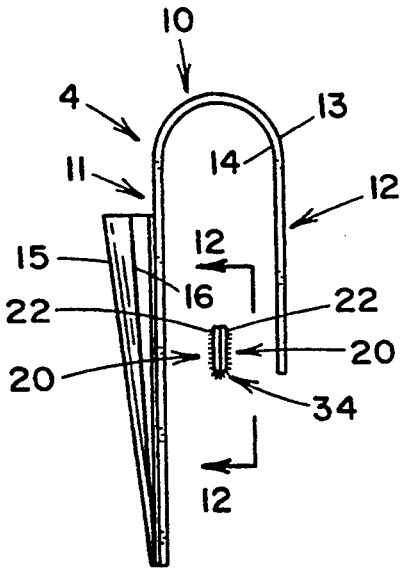
FIG. 11 is a view along line 11—11 in FIG. 10.

The fourth embodiment of the patient caddy 4, as illustrated in FIGS. 10 and 11, is a two pocket caddy similar in construction to the previous embodiments. Fabric panel 10 and pockets 15 are made of a thermoplastic material. The pockets 15 are attached to the fabric panel 10 by heat staking or fusing along seams 32. This can be done by thermal or ultrasonic means.

Figure 12:
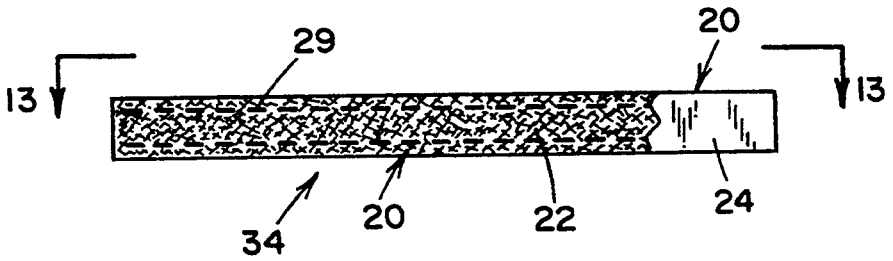
FIG. 12 is a view along line 12—12 in FIG. 11.
Figure 13:
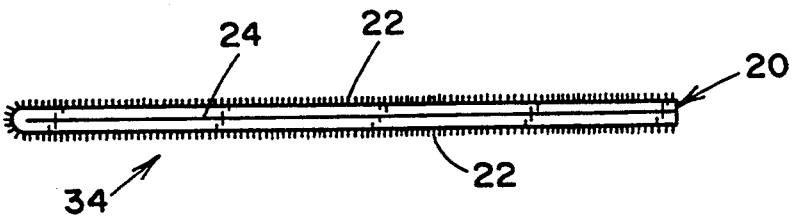
FIG. 13 is a view along line 13—13 in FIG. 12.

A textile fastening strip assembly 34 secures the back 14 of the face portion 11 to the folded portion 12 of fabric panel 10. The textile fastening strip assembly is shown in more detail in FIGS. 11, 12, and 13. A hook type textile fastening strip 20 is folded over such that the plain side 24 is in contact with itself. It is secured in this position by stitching 29. Use of the fastening strip assembly 34 allows the user to install the caddy 4 with the folded portion 12 being secured to either the back 14 or front 13 of the face portion 11.

In the first three embodiments 1, 2 and 3, the fabric panel 10 and the pockets 15 are made of a non-woven cotton or synthetic fabric. A suitable material, sold under the name Pellon TM, is available from Pellon Corporation of New York, N.Y. This Pellon material is fusible and can also be used for the fourth embodiment 4 where the seams are heat fused. The hook and pile type textile fastening strips 20 and 21 are made of Velcro ® or a similar fastening material. The pockets 15 and textile fastening strips 20 and 21 can be attached at stitched seam locations 29, as illustrated in the first, second and third embodiments 1, 2, and 3. If fabrics with thermoplastic properties are utilized, the pockets 15 can be attached by heat staking or fusing as illustrated in the fourth embodiment 4. The textile fastening strips can also have an adhesive on the plain side 24 for attachment.

As illustrated in the first, second, and third embodiments 1, 2, and 3, the hook type textile fastening strip 20 can be attached along the top edge 17 on either the front 13 or back 14 of the folded portion 12. The folded portion 12 would then be folded over and releasably attached to the front 13 or back 14 of the face portion 11 accordingly. When a pile type textile fastening strip 21 is used in conjunction with the hook type fastening strip 20, it will be recognized by those skilled in the art that both textile fastening strips must be in complementary positions on the face and folded portions 11 and 12.

A fastening strip assembly 34, as illustrated in the fourth embodiment 4, can also be used to secure the face and folded portions 11 and 12 together. This adds versatility to the caddy allowing the folded portion 12 to be secured to either the front 13 or back 14 of the face portion 11.

The strap portion 26 of the hook type textile fastening strip 20 can be included on all embodiments and trimmed off if not required. The eyelets 35 and string 37 are also optional. A suitable material for the string 37 is Snow White TM No. 1320 cord available from the Master Company.

Figure 14:
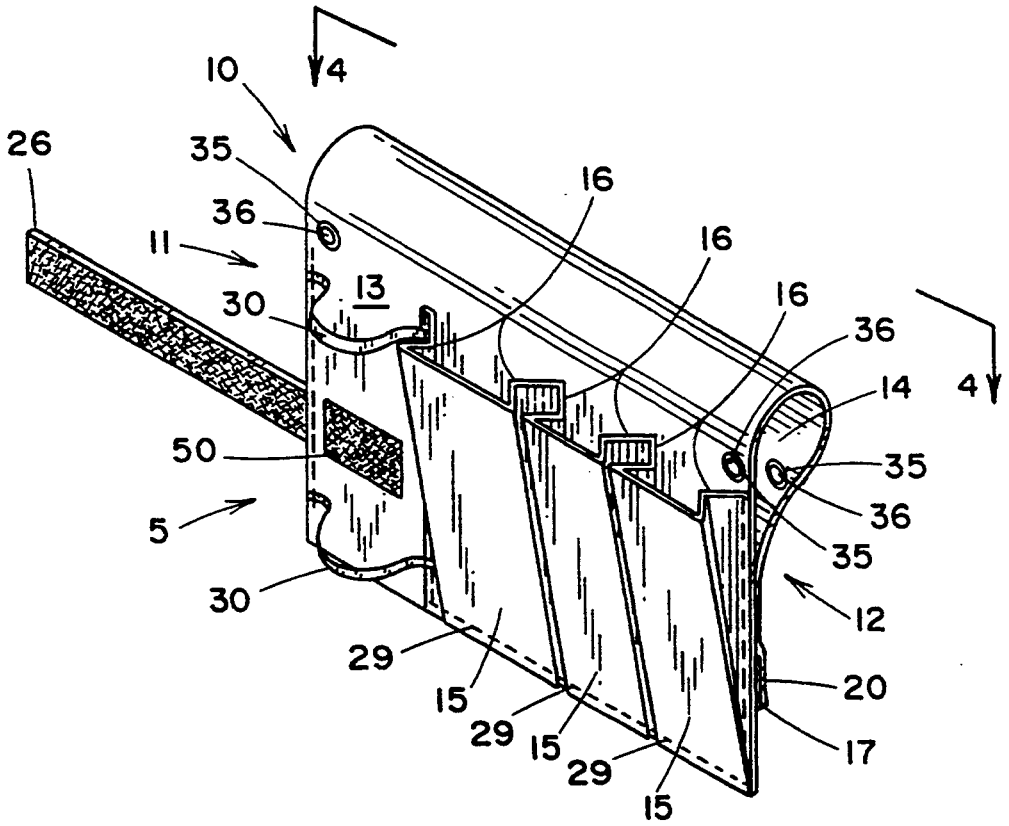
FIG. 14 is a perspective view of a fifth embodiment of the caddy.

A fifth embodiment of the invention 5 is shown in FIG. 14. The fifth embodiment is similar to the first embodiment except that optional pile textile fastening strip 50 is attached to the face portion 11 of the caddy in a position complementary to the hook portion of strip 26. After strip 26 is wrapped around a support post, not shown, it releasably engages the pile fastener strip 50 to secure the caddy 5 in position.

By utilizing non-woven fabric and simple construction techniques, the disclosed patient caddy is suitable for both disposable or reusable use. For instance, in a hospital environment where there are asepsis concerns, a caddy could be disposed of after individual patient use. However, in a nursing home or other longer term patient care facilities, an individual patient's caddy could be washed and reused.

Being readily adaptable to various rail configurations on the many existing types of patient support devices, and utilizing textile fastening strips as a means for securement, the disclosed patient caddy can be easily removed from one patient support apparatus and transferred with the patient to another support apparatus.

I claim:

1. An improved article storage caddy of the type which is suspended from a patient support apparatus to provide convenient storage of miscellaneous articles, wherein the improvement comprises:

a continuous, non-woven fabric panel having a front and a back, a top edge, a bottom edge and side edges, and face and folded portions;

at least two pockets having pleated sides attached to the front of the face portion;

a pair of elastic loops, spaced apart and in alignment with each other, attached to the front of the face portion in a position adjacent to the pockets;

a textile fastening strip attached along the top edge of the folded portion and extending beyond one side edge to form a strap, wherein the strap is releasably secured to the face portion of the non-woven fabric panel.

2. The improvement of claim 1 wherein the non-woven fabric is disposable and washable.

3. The improvement of claim 1 wherein the non-woven material is thermoplastic, and the pockets are heat fused to the face portion.

4. An improved article storage caddy of a type which is suspended from a support apparatus to provide convenient storage of miscellaneous articles, wherein the improvement comprises:

a non-woven fabric panel including a face portion and a folded portion, the face portion includes a plurality of pockets and a pair of spaced apart elastic loops;

a hook textile fastening strip attached to the folded portion;

a pile textile fastening strip attached to the face portion in a complementary position to the hook fastening strip on the folded portion such that the hook textile fastening strip releasably engages the pile fastening strip; and extends beyond the fabric panel forming a strap which releasably engages the face portion to secure the caddy from sliding.

* * * * *